US008096342B2

(12) United States Patent
Scruggs

(10) Patent No.: US 8,096,342 B2
(45) Date of Patent: Jan. 17, 2012

(54) DOOR PACKAGE

(75) Inventor: Edward Scruggs, Monroe, NC (US)

(73) Assignee: Assa Abloy IP AB, Stockholm (SE)

( * ) Notice: Subject to any disclaimer, the term of this patent is extended or adjusted under 35 U.S.C. 154(b) by 283 days.

(21) Appl. No.: 12/568,138

(22) Filed: Sep. 28, 2009

(65) Prior Publication Data

US 2011/0072724 A1 Mar. 31, 2011

(51) Int. Cl.
*E05D 15/00* (2006.01)
*E06B 9/00* (2006.01)

(52) U.S. Cl. ..... 160/211; 160/218; 160/220

(58) Field of Classification Search ..... 160/196.1, 160/197, 202, 211, 210, 218, 220
See application file for complete search history.

(56) References Cited

U.S. PATENT DOCUMENTS

| | | | | | |
|---|---|---|---|---|---|
| 704,887 | A * | 7/1902 | Low | 49/73.1 |
| 877,593 | A * | 1/1908 | Peirano et al. | 160/202 |
| 1,852,608 | A * | 4/1932 | Grable | 160/211 |
| 2,118,942 | A * | 5/1938 | Prescott | 160/185 |
| 2,895,183 | A * | 7/1959 | Dumbolton | 160/197 |
| 3,750,737 | A * | 8/1973 | Woodward | 160/206 |
| 4,305,227 | A * | 12/1981 | Georgelin | 49/141 |
| 4,619,074 | A * | 10/1986 | Leung et al. | 49/143 |
| 4,635,699 | A * | 1/1987 | Kauffman et al. | 160/211 |
| 5,832,980 | A * | 11/1998 | Cianciolo | 160/197 |
| 6,161,334 | A * | 12/2000 | Goodin | 49/125 |
| 6,526,695 | B1 * | 3/2003 | Nguyen | 49/141 |
| 7,299,852 | B1 * | 11/2007 | Chuang | 160/197 |
| 7,451,802 | B2 * | 11/2008 | Cianciolo et al. | 160/211 |
| 7,458,410 | B1 * | 12/2008 | Bronner | 160/197 |
| 7,685,774 | B2 * | 3/2010 | Thielmann | 49/411 |
| 7,950,439 | B2 * | 5/2011 | Anderson | 160/211 |
| 2007/0119548 | A1 * | 5/2007 | Anderson | 160/211 |
| 2007/0169899 | A1 * | 7/2007 | Cianciolo et al. | 160/211 |
| 2009/0250176 | A1 * | 10/2009 | Ryan et al. | 160/185 |

* cited by examiner

*Primary Examiner* — Blair M Johnson
*Assistant Examiner* — Jaime F Cardenas-Garcia
(74) *Attorney, Agent, or Firm* — Mollborn Patents Inc.; Fredrik Mollborn

(57) ABSTRACT

A door package includes a door frame, a door, a handle, and a pivot plate. The frame has a top portion that includes tracks in which door panels can slide. The door includes two or more equal size door panels. The handle protrudes in a direction essentially perpendicular to the door panels and is connected to a latch mechanism for positively engaging with a corresponding latch mechanism in the door frame when the door is in a closed position. The pivot plate is attached to the floor and allows the door panels to pivot from a retracted position to a broken open position essentially perpendicular to the plane of the door. At least two of the door panels separate from each other while the door is pivoting from the retracted position to the broken open position, to allow the handle to be accommodated between the two door panels.

9 Claims, 8 Drawing Sheets

DOOR PACKAGE

BACKGROUND

This invention relates to a door package. There are a variety of requirements that dictate what types of doors can be used in specific settings, and which directly affect door package design and offerings thereof. Some examples of such requirements include building codes, safety codes, customer requirements, or other various types of code requirements.

This is particularly true for hospital environments, such as intensive care units (ICUs), in which an increase of requirements has recently been seen. One requirement is that the door is trackless, that is, the door does not have any threshold or similar arrangement across the door opening, so as to minimize collection of bacteria and various types of debris, and such that patients and ICU equipment can be easily moved through the door opening. Another requirement is that the door should have a U.L. air leakage rated seal around its perimeter, in order to create a seal that serves to minimize germ contamination inside the room by reducing air leakage and infiltration. Furthermore, the door should have a positive latch, that is, the door should be possible to secure to the door jamb, so that the door cannot open by itself after the door has been closed. A positive latch is also required to have a handle that protrudes from the door face, that is, so-called flush pull or finger pull handles are not acceptable.

It is also desirable to have a clear door opening that is as large as possible. This is in order to be able to easily move patients in beds and various types of equipment in and out of the room. Additionally, it is desirable to have a door that is capable of Full Breakout (FBO), so that there is a full package opening clearance for "Emergency Egress" or large equipment passage, and so on. It should be noted that these are merely some examples that are presented in a general way, and that there may be many further, and/or more specific requirements than those listed here.

Generally, existing designs of door packages can meet only a subset of all these requirements. As a result, hospitals typically need to decide from case to case which features are more desirable than others and make a tradeoff by using a door that satisfies the requirements that are deemed to be the most important for the particular use. Whereas this might be sufficient in some cases, it would be desirable to have a door package that is able to meet all code, safety, and customer requirements for a hospital environment, such as an ICU, so that these tradeoffs did not have to be made.

SUMMARY

In general, in one aspect, the invention provides a door package. The door package includes a door frame, a door, a handle, and a pivot plate. The door frame has a top portion, a first jamb connected to a first end of the top portion, and a second jamb connected to a second end of the top portion. The top portion includes one or more tracks that can slideably engage with two or more door panels. The door is movable between a closed position and an open position. The door includes two or more equal size door panels. At least a first door panel of the two or more door panels is slideably engaged with the top portion of the door frame. The handle is located close to an edge of the first door panel and protrudes in a direction essentially perpendicular to the plane of the first door panel. The handle is connected to a latch mechanism in the first door panel, which can positively engage with a corresponding latch mechanism in the first jamb of the door frame when the door is in the closed position. The pivot plate engages with a floor and with the two or more door panels to allow the door to pivot from a fully retracted position to a broken open position that is essentially perpendicular to the plane of the door. This creates an entrance opening having substantially the same width as the distance between the first and second jambs of the door frame. A second door panel of the door, adjacent to the first door panel, can separate from the first door panel while the door is pivoting from the retracted position to the broken open position, such that the handle is accommodated between the first door panel and the second door panel.

Advantageous implementations can include one or more of the following features. The door package can include a cam that is attached to one of the first door panel and the second door panel to cause the first door panel and the second door panel to separate while the door is pivoting from the retracted position to the open position. The door package can include a swing arm attached to the first door panel and the second door panel, respectively. The swing arm has a locked position in which the first and second door panels are kept at an essentially same distance from each other during a sliding operation of the door, and an unlocked position in which the first and second door panels are prevented from separating more than a predetermined distance while the door is pivoting from the retracted position to the broken open position. The predetermined distance can be a distance that is sufficiently large to accommodate the handle in between the first door panel and the second door panel in the broken open position. The pivot plate can include a vertical pin for each door panel of the door, which can temporarily or permanently engage with each door panel when the door panels are in the retracted position and provide an axis around which each door panel can rotate as the door is pivoted from the retracted position to the broken open position.

Each vertical pin can engage with its door panel by means of a pivot block, which is mounted on the door panel and has a configuration such that the pin can slide partly into the pivot block, come to a stop and act as a hinge when the door is pivoted from the retracted position to the broken open position. A seal can be provided around at least part of the perimeter of each door panel to minimize air flow through the door package when the door is in the closed position. At least one of the two or more door panels can include a transparent portion. The door can be a telescopic door having three door panels. The door can be a bi-part door, where each side of the bi-part door has two or more door panels.

The various embodiments of the invention can include one or more of the following advantages. A single door package is provided that meets all the current code requirements for a hospital ICU unit. In particular, the specific features are as follows. The door package is trackless, that is, the ground underneath the door package is free of any tracks, guides, thresholds, and so on, and forms a smooth continuous surface. The door package provides door panels that are of equal length, which achieves a maximum clear door opening (CDO) in ratio to the overall door package size. The door package provides positive latching, that is, an operator door handle protrudes from the door face on both sides of the door package. The door handle also provides a latching mechanism to latch the door panel closed to the jamb when the door is closed. The door package is smoke seal rated, that is, the door package has an adequate sealed design to provide for passing a leak rated certification standard. The door package is conductive, such that there are no isolated parts of the door package that are capable of storing static electrical charges. The door package has a FBO design, such that the doors can be broken out in emergency or other special situations, allowing a full clearance opening of the entire door package width.

The details of one or more embodiments of the invention are set forth in the accompanying drawings and the description below. Other features and advantages of the invention will be apparent from the description and drawings, and from the claims.

DESCRIPTION OF DRAWINGS

Like reference symbols in the various drawings indicate like elements.

DETAILED DESCRIPTION

Figure 1A:
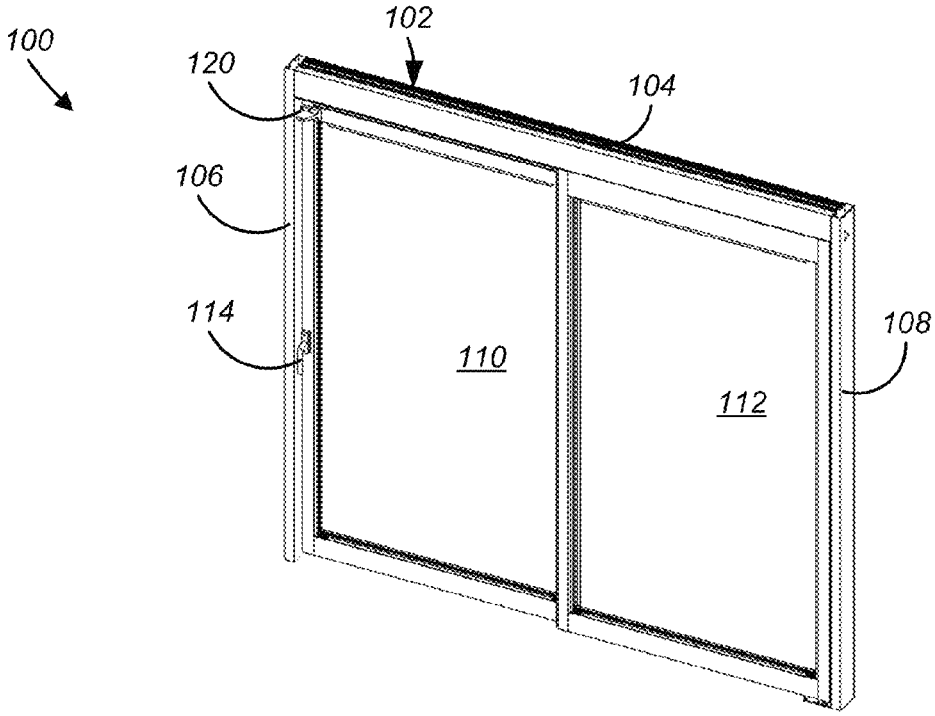
FIG. 1A shows a perspective view of the front of a door package in a closed position, in accordance with one embodiment of the invention.
Figure 1B:
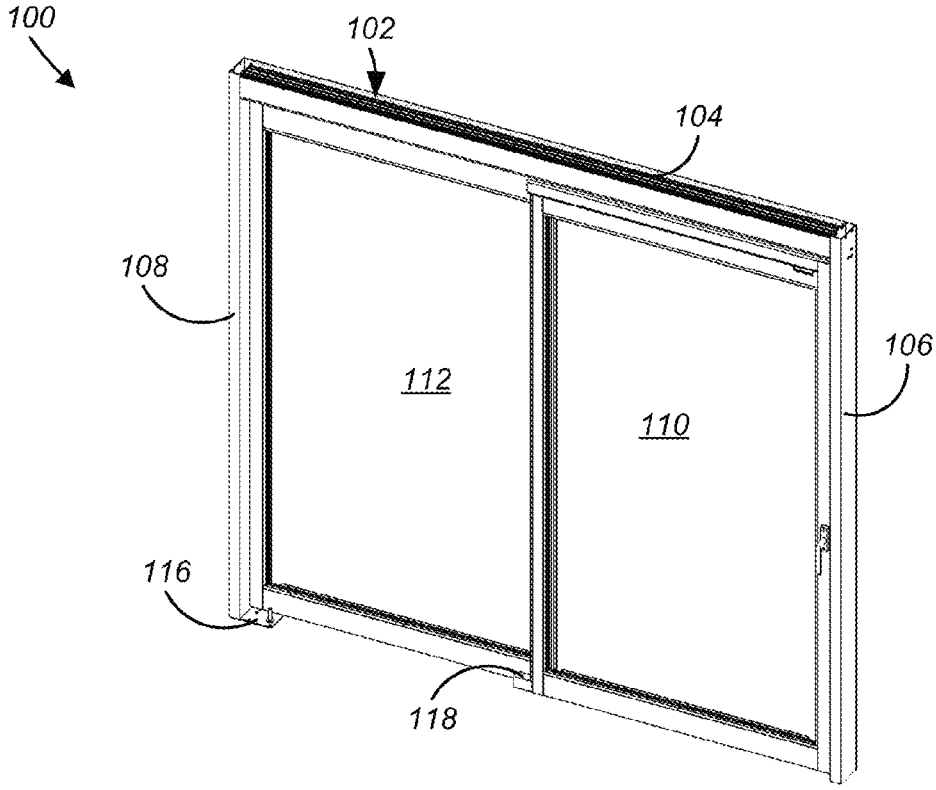
FIG. 1B shows a perspective view of the rear of a door package in a closed position, in accordance with one embodiment of the invention.

FIGS. 1A and 1B, show perspective views of the front and the back, respectively, of one embodiment of a door package (100) in accordance with the invention. As can be seen in FIG. 1A, the door package (100) includes a frame (102) that has a top portion (104), a left jamb (106) and a right jamb (108). The frame (102) can be made of any conventional material that is used for manufacturing door frames, as is well known to those of ordinary skill in the art.

Inside the frame (102) is a door with two door panels; a left door panel (110) and a right door panel (112). This type of door is often referred to as a two-panel single slider package. It should be noted that while FIGS. 1A and 1B show two door panels, in some embodiments the door can be a so-called telescopic door, that is, a door containing three (or more) door panels. In fact, for some applications a three-panel telescopic door may actually be more desirable than a two-panel slider, as the three-panel telescopic door offers a larger CDO compared to a two-panel slider for a door package of the same size. In the illustrated embodiment, the left door panel (110) can slide behind the right door panel (112) along tracks that are located in the top portion (104) of the frame (102). Of course, as the skilled person realizes, depending on different embodiments, the door package (100) can also be configured such that the right door panel (112) slides behind the left door panel (110). It should further be noted that there are no tracks on the floor in which the left door panel (110) can slide. That is, the door package (100) is a trackless door package (100). Additionally, the door package (100) has an FBO design, which will be described in further detail below.

Attached to the left door panel (110) is a handle (114) that can positively latch into the left jamb (106). The handle (114) protrudes from either side of the left door panel (110) and can be gripped by a person and rotated slightly to unlatch the left panel (110) from the left jamb (106). While holding the handle (114), the person can slide the left panel (110) behind the right panel (112) to achieve a maximum clear door opening (CDO) of the door in relation to its package size. It should be noted that the left door panel (110) and the right door panel (112) in accordance with various embodiments of the invention are of equal size. Having equal size door panels allows the CDO to be larger than for conventional sliding doors, in which one panel typically is wider than the other panel. At the top of the left door panel (110), above the handle (114) is a cam (120). The cam (120) acts as a separator between the left door panel (110) and the right door panel (112) when the telescopic door is pivoted open, thereby allowing for the handle (114) to rest in between the left door panel (110) and the right door panel (112). This operation will be described in further detail below.

FIG. 1B shows a rear perspective view of the door package (100) of FIG. 1A in a closed position. As can be seen, most of the features shown in FIG. 1B have been described above. It should be noted, though, that there is a pivot plate (116) on the floor, which is partly visible from the rear of the door. As will be described in further detail below, one side of the right door panel (112) is attached to the floor plate (116) and to the top portion (104) of the frame (102), respectively. When the left door panel (110) is retracted behind the right door panel (112), a pivot block (118) engages with a pin on the floor plate (116). With the pin engaged, the two door panels can "swing open," similar to a regular hinged door, when a user applies an outward force to the door panels.

Figure 2A:
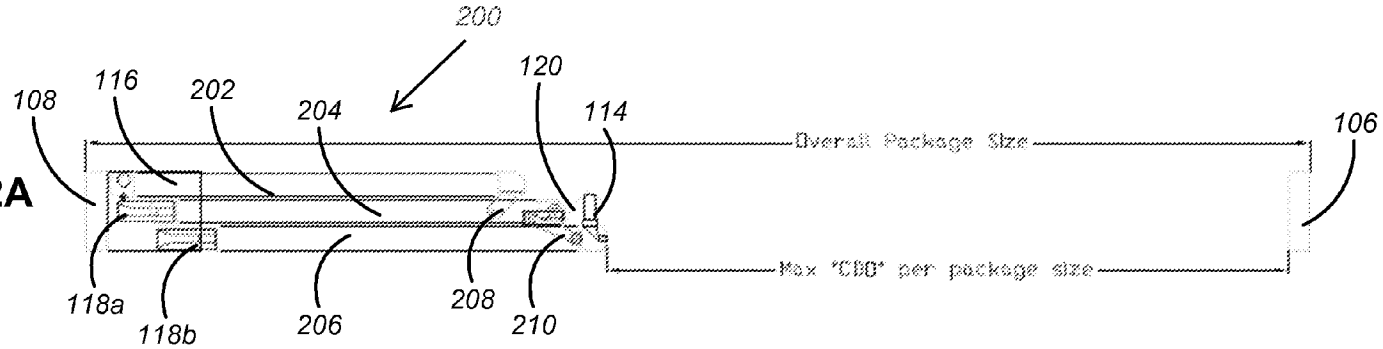
FIG. 2A shows a top view of a three panel door package in accordance with one embodiment of the invention in an open position.
Figure 2B:
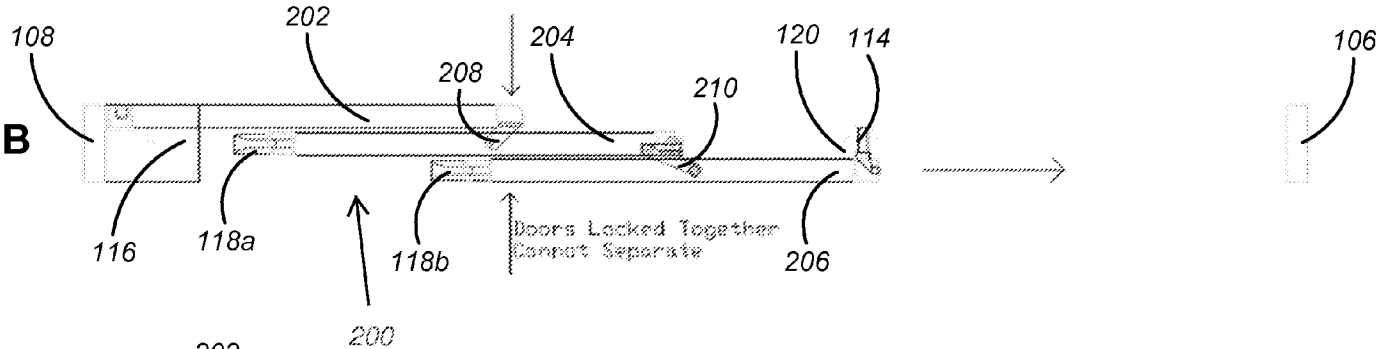
FIG. 2B shows a top view of the door package of FIG. 2A in a partly closed position.
Figure 2C:
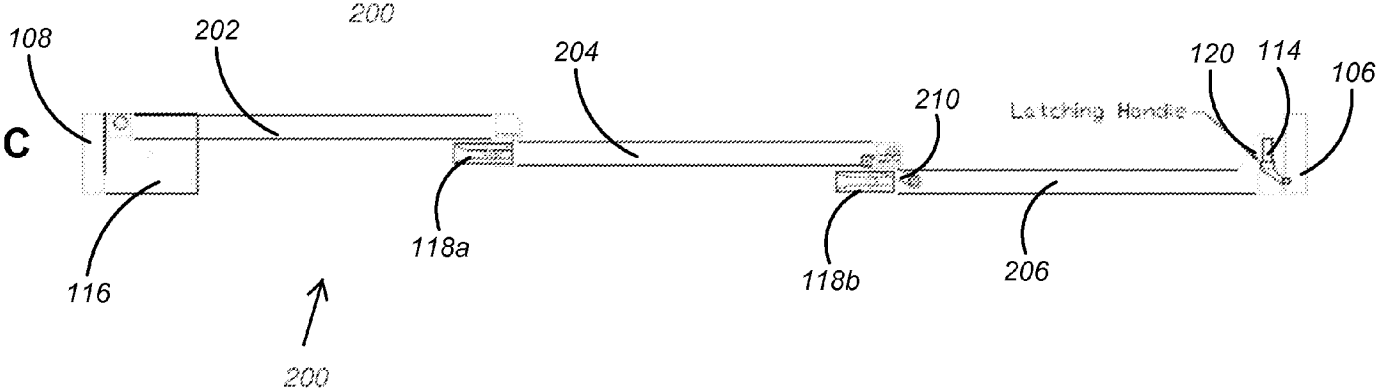
FIG. 2C shows a top view of the door package of FIG. 2A in a fully closed position.

The sliding door operation will now be explained in greater detail with reference to FIGS. 2A-2C, which show a bottom-up view of a telescopic door package during a sliding operation in accordance with one embodiment of the invention. In order to better explain the sliding function, a three-panel telescopic door (200) is illustrated in FIGS. 2A-2C. As can be seen in FIG. 2A, the door has a first door panel (202), a second door panel (204) and a third door panel (206). The first door panel (202) is attached to the pivot plate (116) and to a corresponding pivot (not shown) at the top portion (104) of the door frame (102), as described above. At the other end of the first door panel (202), on the bottom side, is a door guide pin assembly (208) which is slideably attached to the second door panel (204). The door guide pin assembly (208) allows the second door panel (204) to slide parallel to the first door panel (202), and keeps the second door panel (204) at a given distance from the first door panel (202) during a sliding operation of the telescopic door, so that no separation occurs between the first door panel (202) and the second door panel (204).

The second door panel (204) has a pivot block (118*a*) on one end. The pivot block (118*a*) engages with a pin on the pivot plate (116), as will be described in further detail below, when the telescopic door is in its retracted position, that is, when both the second panel (204) and the third panel (206) are pulled behind the first panel (202). A corresponding pivot is located at the top of the door. At the opposite end of the pivot block (118*a*), the second door panel (204) has a swing arm (210). The swing arm (210) is attached to the third door panel (206) and has a locked and an unlocked mode.

In the locked mode, which is used during normal sliding operation of the telescopic door, the swing arm (210) acts similar to the door guide pin assembly (208) on the first door panel (202), in that the swing arm (210) keeps the second door panel (204) and the third door panel (206) together and only let them slide relative to each other without separating from each other. In the unlocked mode, which is temporarily entered when the door panels are pivoted open, the swing arm (210) allows the second door panel (204) and the third door panel (206) to temporarily separate a distance that is determined by the swing arm (210) and that is sufficiently big to accommodate the handle (114) between the second door panel (204) and the third door panel (206) while the telescopic door is swung open.

Figure 3A:
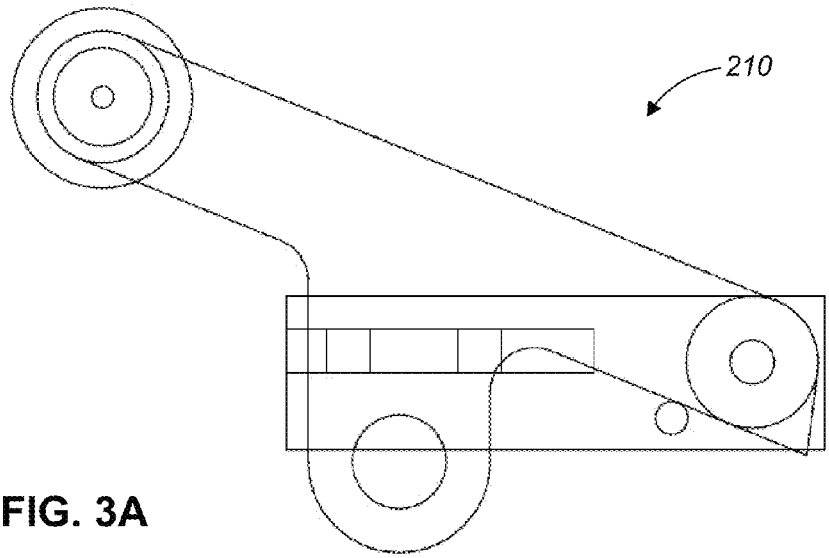
FIG. 3A shows a close-up of the swing arm in the locked position, in accordance with one embodiment of the invention.
Figure 3B:
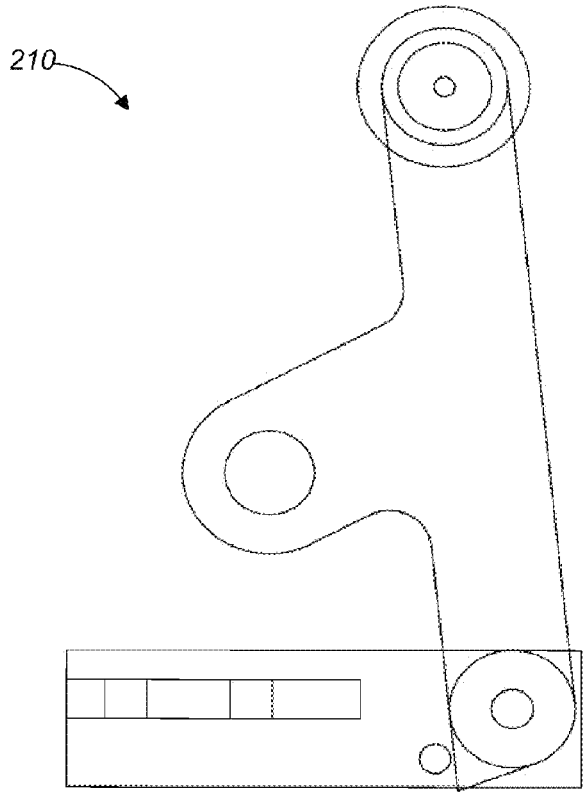
FIG. 3B shows a close-up of the swing arm in the temporarily open position, in accordance with one embodiment of the invention.

FIG. 3A shows a close-up of the swing arm (210) in the locked position and FIG. 3B shows a close-up of the swing arm (210) in the temporarily open position. The swing arm (210) performs several unique operations. As was described above, during normal sliding door operation, the swing arm (210) remains in its locked position, as shown in FIG. 3A. In one embodiment, a manually operated lock rod is used to lock the swing arm (210) into its locked position, which will be described in further detail with reference to FIGS. 5A and 5B. With the swing arm (210) in the locked position shown in FIG. 3A, the door panels are prevented from separating from each other, thereby maintaining control of the door panels, as well as maintaining a seal between the door panels. The dimensions of the swing arm (210) are such that the swing arm (210) can pass through the rear pivot block, enabling its use with an equal panel door. Furthermore, when the swing arm (210) is unlocked, as shown in FIG. 3B, the door panels remain attached and cannot "flop" or "bang around" which would be the case, were the panels independent. In one embodiment, the swing arm (210) also has a stop pin, which prevents the swing arm (210) from over-rotating. This is desirable, as an over-rotation of the swing arm (210) could cause the door panels to bind when attempting to close the door panels after a FBO.

Returning now to FIG. 2C, the third door panel (206) also has a pivot block (118*b*) on one end. The pivot block (118*b*) engages with a different pin on the pivot plate (116) when the telescopic door is in its retracted position. The protruding handle (114) of the door is located on the third door panel (206), at the opposite end of the pivot block. When the door is in the closed position, as shown in FIG. 2C, the handle (114) is latched to the left jamb (106), using a conventional latching mechanism. As was described earlier, attached to the third door panel (206), above the handle (114), is a cam (120), whose functionality will be described in greater detail below with respect to FIGS. 4A-4D. In the illustrated embodiment, the cam has the shape of a segment of a circle and extends out from the third door panel (206) a distance that is slightly larger than the distance the handle (114) extends from the third door panel (206).

To slide the door open, a user grips the handle (114) and rotates it slightly, which causes the handle (114) to unlatch from the left jamb (106). The user then slides the door open, such that two of the door panels slide behind the third door panel and reveals a maximum CDO, as shown in FIG. 2A. It should be noted that the third door panel (206) stops before the handle (114) engages with the second door panel (204). In this open position, each of the door panels' pivot blocks engage with a respective pin on the pivoting plate (116) and the door panels can be "swung open" or "broken open," similar to how a conventional hinged door opens. This will now be described in further detail with respect to FIGS. 4A-4D.

Figure 4A:
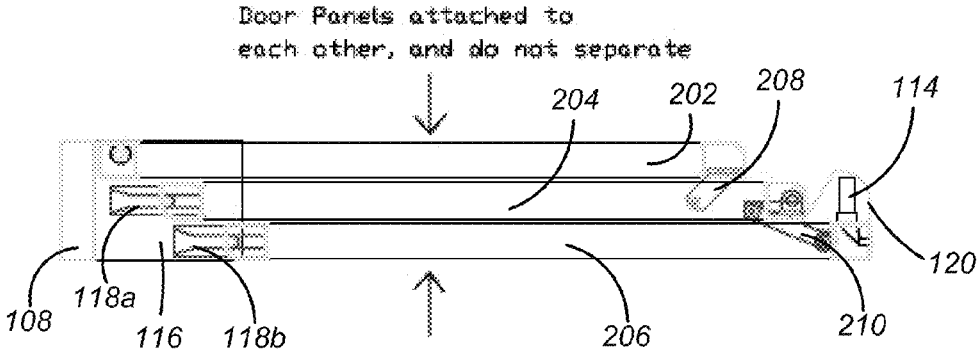
FIG. 4A shows a top view of the door panels when the door is in a slid open position, in accordance with one embodiment of the invention.

FIG. 4A shows a top view of the door panels when the telescopic door is in a slid open position, in accordance with one embodiment of the invention. As can be seen in FIG. 4A, the swing arm (210) is in its locked position, which causes the door panels to be attached to each other so that they cannot separate.

Figure 4B:
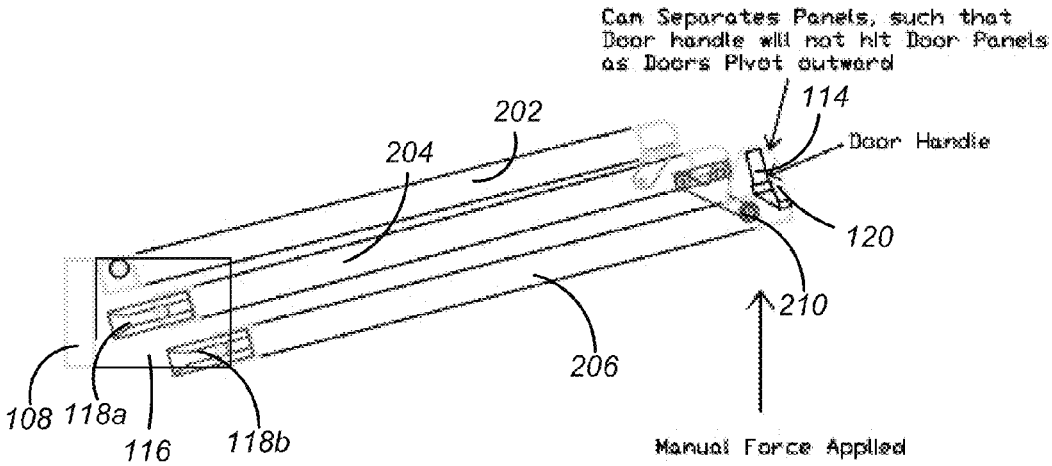
FIG. 4B shows a top view of the door panels in FIG. 4A when a manual force is applied to the door to break the door open, in accordance with one embodiment of the invention.
Figure 4C:
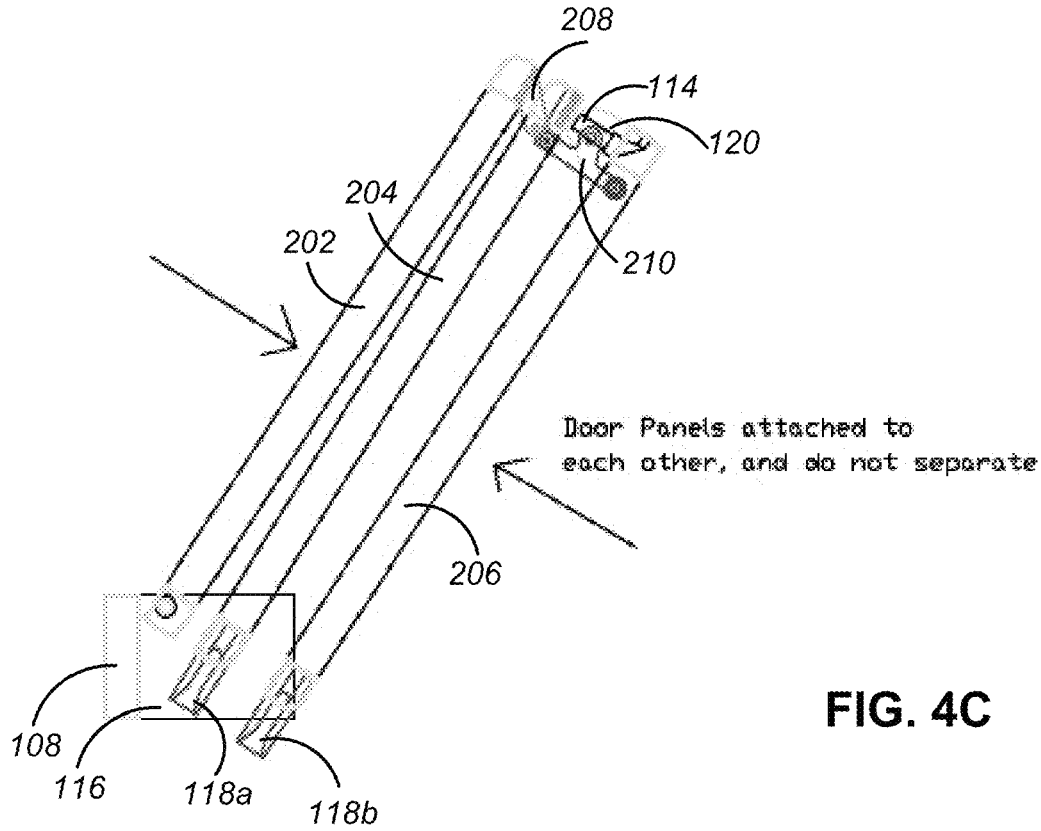
FIG. 4C shows a top view of the door panels in FIG. 4A when the door is partly broken open, in accordance with one embodiment of the invention.
Figure 4D:
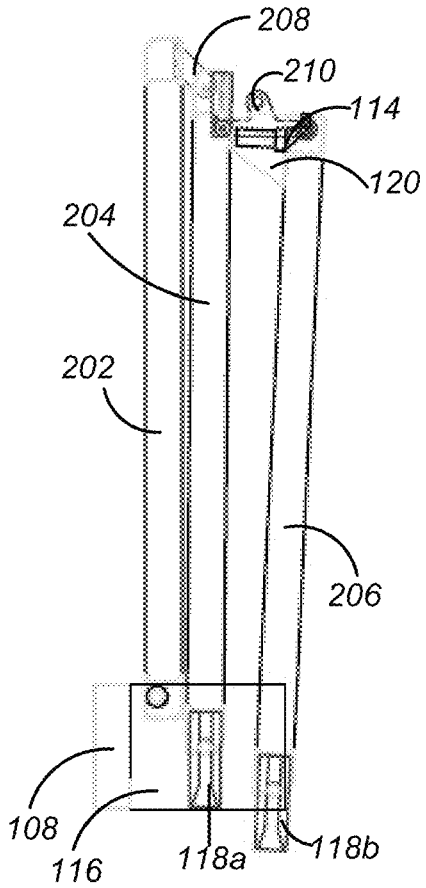
FIG. 4D shows a top view of the door panels in FIG. 4A when the door is fully broken open, in accordance with one embodiment of the invention.

In FIG. 4B, a manual force is applied to the third door panel, typically by a user gripping the handle or pushing on an area close to the handle, in order to break the door open. This causes the respective door panels to pivot around the pins on the pivoting plate (116). As the door is being broken open, the third door panel (206) is pushing the second door panel (204) while being pulled behind the second door panel (204). During this process, the cam (120) on the third door panel (206) engages with the second door panel (204), causing the second door panel (204) and third door panel (206) to separate. This prevents the handle (114) from running into the second door panel (204) as the door is being broken open. Also, during this process, the swinging arm (210) moves from its latched position to its temporarily open position. As a result, the second door panel (204) and the third door panel (206) are held together so that they only separate from each other a distance that is sufficient to accommodate the handle (114) and the cam (120). These operations can be understood more clearly by studying FIG. 4C, which shows the door in a further broken open position, and FIG. 4D, which shows the door in a fully broken open position.

Figure 5A:
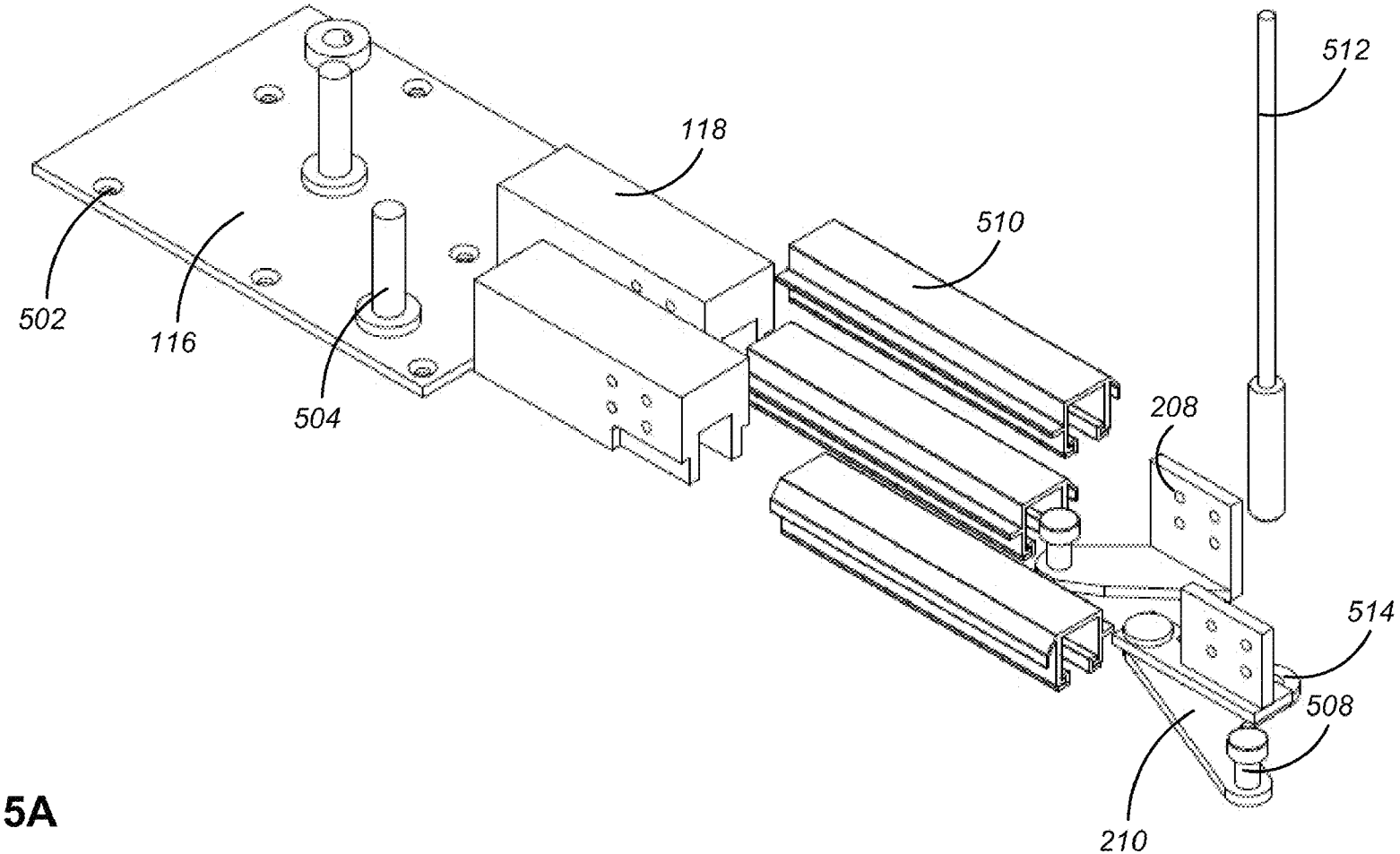
FIG. 5A shows a perspective breakout view of selected portions along the bottom of the door package, in accordance with one embodiment of the invention.
Figure 5B:
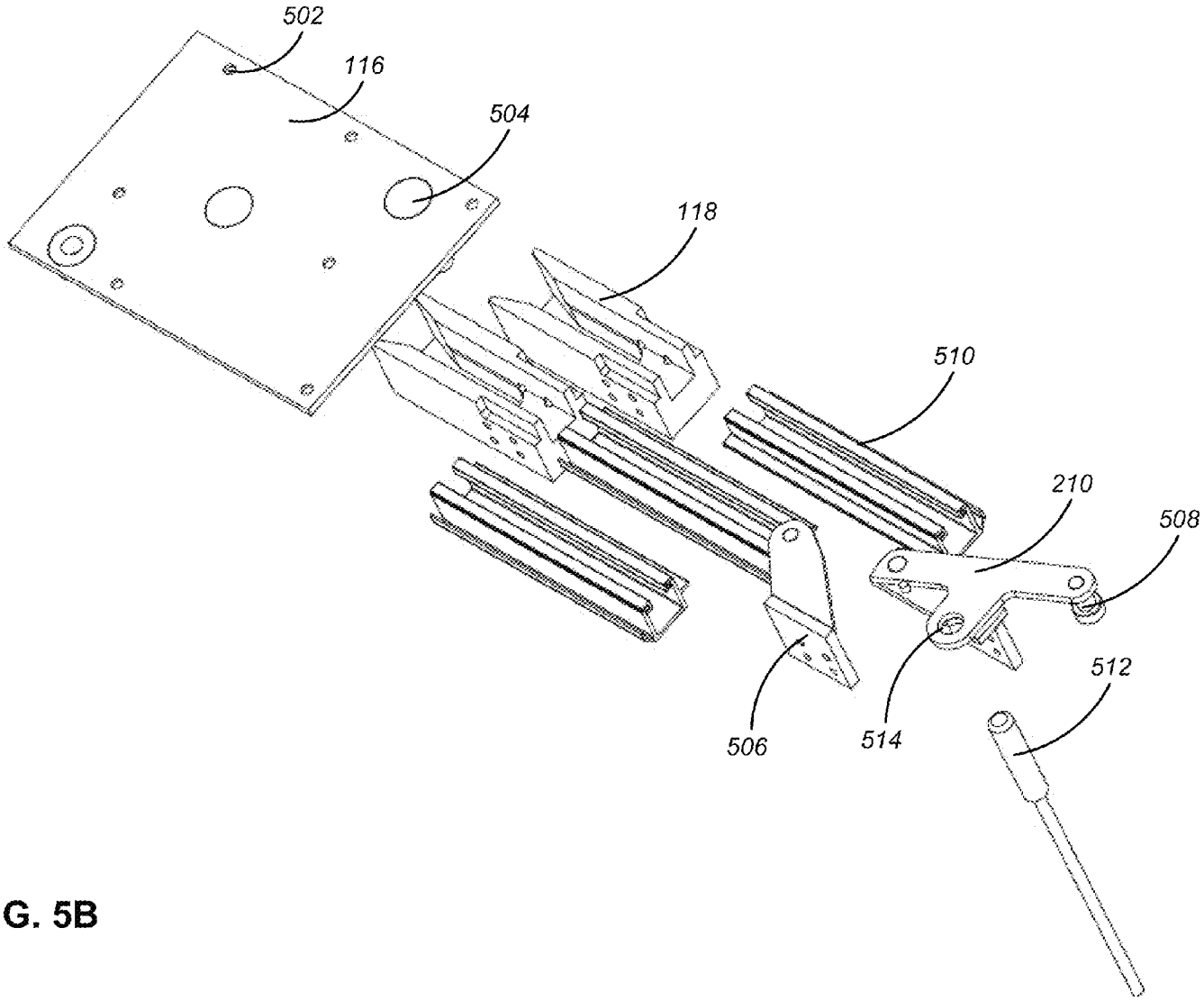
FIG. 5B shows a perspective breakout view of selected portions along the bottom of the door package, in accordance with one embodiment of the invention.

FIGS. 5A-5B, which show perspective breakout views of selected portions along the bottom of the door package, in accordance with one embodiment of the invention. The illustrated components are essentially mirror images of each other, so their functionality will be explained with respect to the figure that best illustrates how each component works.

As can be seen in FIG. 5A, the pivot plate (116) contains a number of holes, through which appropriate hardware can be inserted to secure the door package (100) to the bottom of the door opening where the door package (100) will be installed. The pivot plate (116) also contains a pivot pin (504) for each door panel. As was described above, the pivot pins (504) effectively act as hinges when the door panels are broken open.

Each door panel, except the door panel (206) with the handle (114), is attached to a door guide pin assembly (208) at the bottom, respectively, of each door panel. The door panel (206) with the handle is attached to the swing arm (210)

instead, as described above with reference to FIGS. 3A and 3B. Each door guide pin assembly (208) and the swing arm (210) has a pin (508) which slides inside an internal door track (510) for each door panel and enables the sliding movement for each door panel.

Each internal door track (510) abuts a pivot block (118), allowing the pins (508) of the door guide pin assemblies (208) and the swing arm (210), respectively, to slide into the respective pivot blocks (118) when the door is closed. As can be seen in FIG. 5B, the pivot blocks (118) are shaped such that they are wider at the end that engages with the pivot pins (504). Furthermore, the pivot blocks (118) are shaped such that the pivot pins (504) only can slide partly into the pivot blocks (118). In the embodiment shown in FIG. 5A, this is accomplished by having a deeper groove in the pivot blocks (118) at the end where the pivot pins (504) enter and then changing the groove to be more shallow a certain distance into the pivot block (118). Of course, this functionality can also be achieved in other ways that can be envisioned by those having ordinary skill in the art. Once the pivot pins (504) have slid into their final position inside the pivot blocks (118) as the door panels are slid open, the pivot pins act as conventional hinges and allows the door to be broken open, as described and shown above.

A manual lock rod (512) is also illustrated in FIGS. 5A and 5B. The lock rod (512) engages with a hole (514) in the swing arm (210) in response to a user acting on the lock rod, and locks the swing arm (210) into its locked position, as described above, thereby preventing the door panels from separating from each other during the sliding operation. When the lock rod (512) is removed, the swing arm (210) is in its unlocked position and the door can be broken open, as described above, and sufficient space can be created to accommodate the door handle (114) between two of the door panels. In one embodiment, the lock rod (512) is mounted on a rotating knob or dial on the outside of the door, and engages and disengages, respectively, with the hole (514) in the swing arm (210) in response to a user rotating the dial.

Figure 6A:
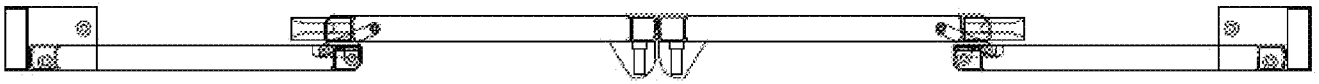
FIG. 6A shows a top view of a bi-parting door package with two two-panel doors, in accordance with one embodiment of the invention.
Figure 6B:
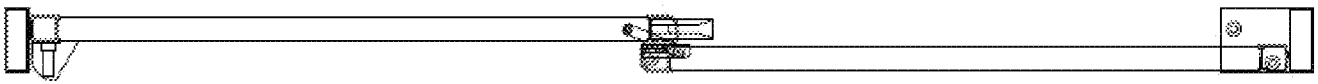
FIG. 6B shows a top view of a door package with a two-panel door, in accordance with one embodiment of the invention.
Figure 6C:
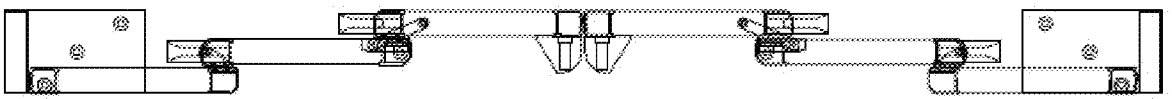
FIG. 6C shows a top view of a bi-parting door package with two telescopic three-panel doors, in accordance with one embodiment of the invention.
Figure 6D:
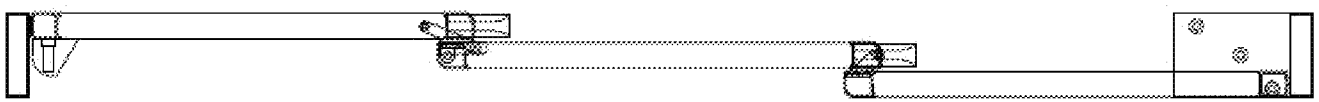
FIG. 6D shows a top view of a door package with a telescopic three-panel door, in accordance with one embodiment of the invention.

A number of embodiments of the invention have been described. Nevertheless, it will be understood that various modifications may be made without departing from the spirit and scope of the invention. For example, the door panels can be made of glass to be transparent or translucent, or can be made of any other suitable material, and optionally be provided with one or more windows of various sizes and locations. The above-described components can be used in various door package embodiments, such as telescopic (show in FIG. 6D), telescopic bi-part (shown in FIG. 6C), two-panel (shown in FIG. 6B), and two-panel bi-part (shown in FIG. 6A) door packages. Accordingly, other embodiments are within the scope of the following claims.

The invention claimed is:

1. A door package, comprising:

a door frame having a top portion, a first jamb connected to a first end of the top portion, and a second jamb connected to a second end of the top portion, the top portion including one or more tracks operable to slideably engage with two or more door panels;

a door movable between a closed position and an open position, the door including two or more equal size door panels, wherein at least a first door panel of the two or more door panels is slideably engaged with the top portion of the door frame;

a handle located close to an edge of the first door panel, wherein the handle protrudes in a direction essentially perpendicular to the plane of the first door panel, the handle being connected to a latch mechanism in the first door panel, the latch mechanism being operable to positively engage with a corresponding latch mechanism in the first jamb of the door frame when the door is in the closed position; and a pivot plate, the pivot plate being engageable with a floor and with the two or more door panels to allow the door to pivot from a fully retracted position to a broken open position that is essentially perpendicular to the plane of the door, thereby providing an entrance opening having substantially the same width as the distance between the first and second jambs of the door frame;

wherein a second door panel of the door, adjacent to the first door panel, is operable to separate from the first door panel while the door is pivoting from the retracted position to the broken open position, such that the handle is accommodated between the first door panel and the second door panel.

2. The door package of claim 1, further comprising a cam, the cam being attached to one of the first door panel and the second door panel to cause the first door panel and the second door panel to separate while the door is pivoting from the retracted position to the open position.

3. The door package of claim 1, further comprising a swing arm attached to the first door panel and the second door panel, respectively, the swing arm having a locked position in which the first and second door panels are kept at an essentially same distance from each other during a sliding operation of the door, and an unlocked position in which the first and second door panels are prevented from separating more than a predetermined distance while the door is pivoting from the retracted position to the broken open position.

4. The door package of claim 3, wherein the predetermined distance is a distance that is sufficiently large to accommodate the handle in between the first door panel and the second door panel in the broken open position.

5. The door package of claim 1, wherein the pivot plate includes a vertical pin for each door panel of the door, the pins being operable to temporarily or permanently engage with each door panel when the door panels are in the retracted position and to provide an axis around which each door panel can rotate as the door is pivoted from the retracted position to the broken open position.

6. The door package of claim 1, wherein each vertical pin engages with its door panel by means of a pivot block, the pivot block being mounted on the door panel and having a configuration such that the pin can slide partly into the pivot block, come to a stop and act as a hinge when the door is pivoted from the retracted position to the broken open position.

7. The door package of claim 1, wherein at least one of the two or more door panels includes a transparent portion.

8. The door package of claim 1, wherein the door is a telescopic door having three door panels.

9. The door package of claim 1, wherein the door is a bi-part door, each side of the bi-part door having two or more door panels.

* * * * *